United States Patent [19]

Johnson

[11] Patent Number: 4,809,778

[45] Date of Patent: Mar. 7, 1989

[54] OIL WELL TOOL FOR IN SITU RELEASE OF WELLBORE TREATMENT FLUID

[75] Inventor: Irvin D. Johnson, Englewood, Colo.

[73] Assignee: Marathon Oil Company, Findlay, Ohio

[21] Appl. No.: 89,717

[22] Filed: Aug. 26, 1987

[51] Int. Cl.[4] ..... E21B 37/00; E21B 37/06; E21B 41/02

[52] U.S. Cl. ..... 166/310; 166/162; 166/169; 166/304; 166/312

[58] Field of Search ..... 166/162, 163, 165, 168, 166/169, 305.1, 311, 310, 279; 222/211, 214, 215

[56] References Cited

U.S. PATENT DOCUMENTS

| | | | |
|---|---|---|---|
| 219,440 | 9/1879 | Boles et al. . | |
| 2,089,479 | 8/1937 | Herbsman . | |
| 2,387,002 | 10/1945 | Bannister | 166/169 X |
| 2,453,068 | 11/1948 | Haynes | 166/19 |
| 2,523,608 | 9/1950 | Bell | 166/169 X |
| 2,852,080 | 9/1958 | Roach | 166/310 X |
| 4,421,166 | 12/1983 | Cain | 166/162 |

*Primary Examiner*—Stephen J. Novosad

*Attorney, Agent, or Firm*—Jack L. Hummel; Rodney F. Brown

[57] ABSTRACT

An oil well tool for in situ release of treatment fluid into an oil well is disclosed. A tubular body is insertable into an oil well casing, which tubular body carries a bladder containing treatment fluid. The body is closed at a lower end and has at an upper end a fishing neck connector. A weight slideable within the tubular body compresses the treatment fluid within the bladder and forces the treatment fluid under a constant pressure through a fluid passageway. The size and length of the fluid passageway, combined with the pressure applied and viscosity of the treatment fluid, dictate the flow rate at which the treatment fluid is deposited into the oil well. The treatment fluid mixes with other fluids being circulated through the well formation. The primary purpose for the treatment fluid is to inhibit scale buildup and corrosion. This is accomplished by slow release of the treatment fluid over an extended period of time.

16 Claims, 3 Drawing Sheets

OIL WELL TOOL FOR IN SITU RELEASE OF WELLBORE TREATMENT FLUID

BACKGROUND OF THE INVENTION

1. Field of the Invention

The present invention relates to tools for use in oil wells. More particularly, the invention relates to methods and apparatus for supplying treatment fluid to a wellbore casing of an oil well.

2. Description of the Prior Art

The problem addressed by the present invention is how to maintain a producing oil well in operating condition for extended periods of time without the need for replacing the downhole well tubing or casing. In a producing oil well, chemicals, which typically produce scale buildup and are corrosive to steel used to manufacture the oil well casing, are pumped from the well formation through perforations formed in the casing.

The chemicals circulated through the well casing, at the relatively high temperatures encountered, can eventually corrode the casing or cause scale buildup, which substantially restricts the flow of oil through the casing. Once these problems occur, the well then has to be taken out of production and the entire casing replaced at great expense in time and lost production.

Treatment fluid is available to impede scale buildup and the corrosion process. Other treatment fluids which reduce viscosity and inhibit wax buildup are also available. The prior art does not include any showing wherein treatment fluid is slowly released with the chemicals being circulated through the well formation and the casing.

No prior art is known which shows a flexible bladder to eject treatment fluid into a wellbore by means of compressing the bladder with a piston-like weight. W. H. Boles (U.S. Pat. No. 219,440) discloses a means for venting pressure from a beer barrel. This vent functions in a manner to keep a constant pressure in the barrel. A weight is used to force air out of a bag and into the beer barrel to maintain a constant static pressure within the barrel.

Prior art patents for cleaning wellbores by discharge of chemical fluids include A. M. Herbsman (U.S. Pat. No. 2,089,479) and J. D. Haynes (U.S. Pat. No. 2,543,068). Both Herbsman and Haynes disclose means for dumping fluids into wellbores. Both use a piston to discharge fluid into the wellbore. Herbsman uses a tubular barrel having a plunger slideable there along and a releaseable dump valve. Herbsman therefore disgorges the entire contents of the barrel, which are contemplated to be potassium or sodium, into a well formation adjacent the bottom of the casing.

In a like manner to Herbsman, Haynes uses a container to hold a quantity of liquid material to be deposited in the oil well. The outside diameter of the container is less than that of the wellbore. A piston mechanical means is used to move the piston to discharge the liquid contents of the container.

Objects and Summary of the Invention

The principle object of the present invention is to provide an in situ oil well tool for releasing treatment fluid into an oil well.

It is a related object of the invention to provide an oil well tool with means for releasing treatment fluid over an extended period of time.

It is a further related object of the invention to provide an oil well tool for releasing treatment fluid with a minimum of moving parts and which operates efficiently.

It is still another related object of the intention to provide a method for supplying treatment fluid to the oil well.

In accordance with the objects of the invention, an oil well tool for releasing treatment fluid is seen to include a tubular body having a comector end, for attachment to means for lowering the oil well tool into an oil well, and a capped end. The tubular body includes mounted therein an elongated flexible bladder, which is filled, and refilled for reuse, with treatment fluid. The bladder is sealingly connected at one lower end to a cap at the capped end and at the other upper end to a weighted piston or compression means for applying a constant pressure to the bladder. The compression means has a first fluid passageway therethrough which is connected to a capillary tube providing fluid communication from the interior of the bladder to the connector end. A second fluid passageway through the connector end communicates fluid from the interior of the bladder, through the first fluid passageway, into the wellbore.

As treatment fluid is ejected, the bag collapses. A bag catcher collects the collapsed portion and stores the bag until the oil well tool is refilled. The cap has a filling passageway formed therethrough for refilling the oil well tool.

The oil well tool is preferably located in a perforation zone of an oil well casing so that treatment fluid is ejected into the circulation pattern of the producing oil well. The method of the invention contemplates locating the well tool at a pre-established location in the producing well and slowly releasing treatment fluid into the chemical and oil flow of the oil well. The treatment fluid will be entrained with oil from the formation and carried up the oil well casing at a predetermined flow rate, treating the casing as it does so.

DESCRIPTION OF THE PREFERRED EMBODIMENT

Figure 1:
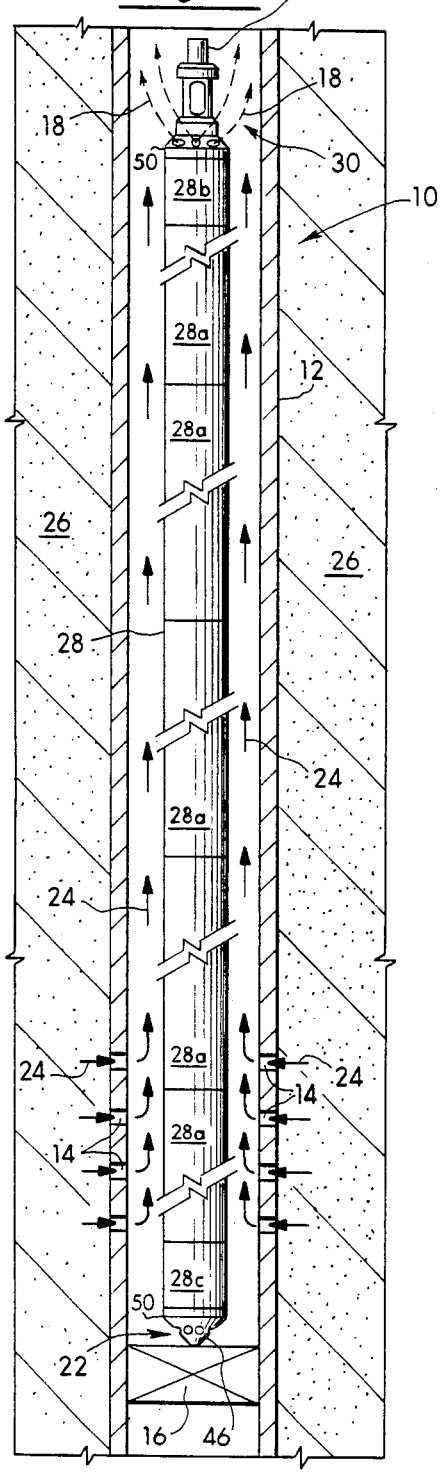
FIG. 1 is a front elevational view of an inhibitor release oil well tool of the present invention, the oil well tool positioned in the perforation zone of an oil well casing, portions being removed for clarity.
Figure 2:
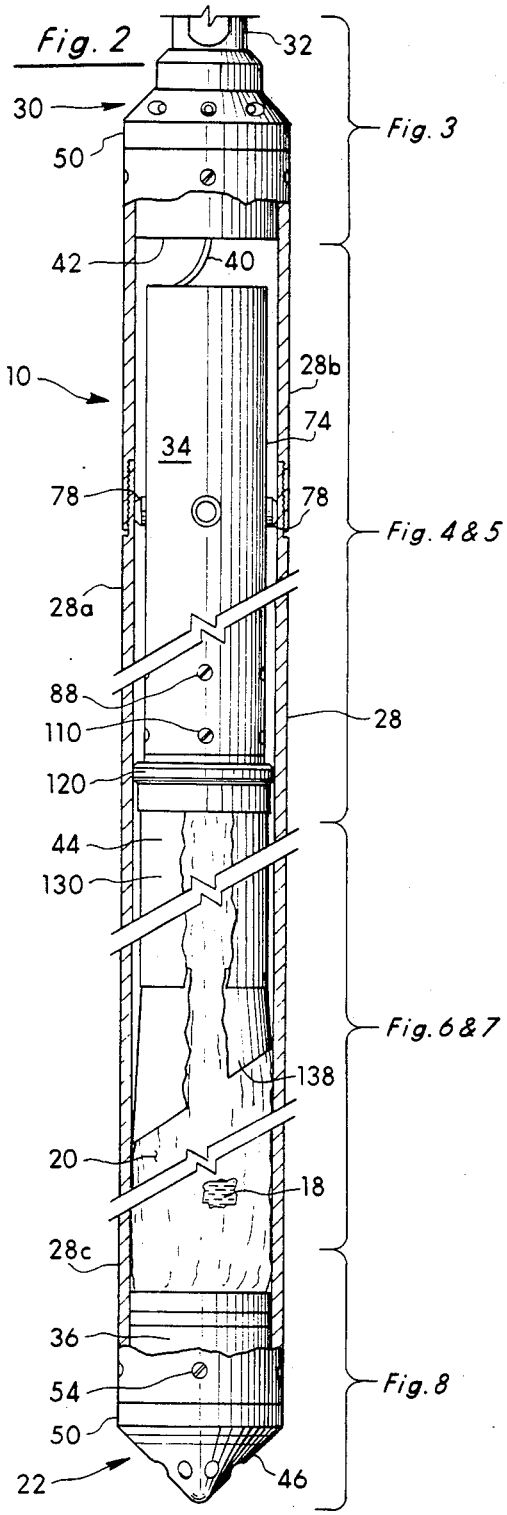
FIG. 2 is a fragmentary sectional view of the invention shown in FIG. 1, certain portions shown full.

An inhibitor release oil well tool 10 carries stored treatment fluid 18. The tool 10 is lowered into a wellbore casing 12 by known means to the area of the casing 12 where perforations 14 are made in the casing 12. (FIG. 1). The perforations 14 allow for fluid circulation of chemicals and oil 24 of a producing oil well in a well known manner. A packer or bridge support 16 engages a frustoconical lower capped end 22 of the oil well. The tool 10 ejects treatment fluid 18 stored in a TEFLON-coated KAPTON (trademarks of E. I. DuPont de Nemours and Co., Wilmington, Del. USA), or like high strength flexible and liquid impermeable material, bag or bladder 20. (FIG. 2). The treatment fluid 18 mixes with the chemicals and oil 24 being circulated through the perforations 14 and along the casing 12. The chemicals and oil 24 are pumped from an oil bearing formation 26. Principle among treatment purposes for the treatment fluid 18 is the inhibition or prevention of scale buildup on the interior of the casing 12. In addition, treatment fluid for applications relating to corrosion, viscosity treatment and wax buildup are con- templated.

The tool 10 includes a tubular body 28 made of titanium or nickel alloy steel having a high corrosion resistance. The interior of the body 28 is coated with Teflon, or other fluorocarbon resin, or similar material, for purposes to be discussed hereafter. The tubular body 28 has an outside diameter of four to four and one half inches, less than the inside diameter of the casing 12, about seven inches, so as to be insertable into the casing 12. The body 28 is approximately fifty feet in overall length. A connector end 30 has a fishing neck 32 connected to the tubular body 28. The fishing neck 32 is a modification of existing downhole oil well tool technology for use in raising and lowering tools.

Figure 8:
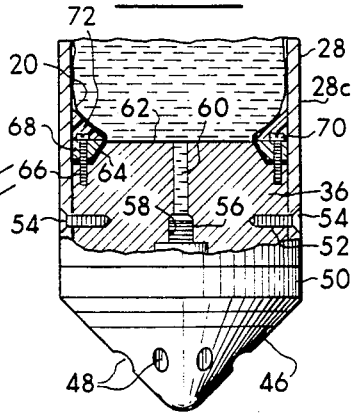
FIG. 8 is a fragmentary sectional view of a cap and nose of the invention shown in FIG. 1.

Compression means or weighted piston 34 is slidably mounted along the interior of the tubular body 28, intermediate the connector end 30 and the lower capped end 22 of the tool 10. A lower end of the weighted piston 34 is sealingly connected to an upper end of the bag 20 while a lower end of the bag 20 is sealingly connected to a cap 36, which cap 36 is selectively connected to the capped end 22 of the tubular body 28. (FIGS. 2 and 8). The piston 34 slides easily along the coated interior of the body 28.

Figure 3:
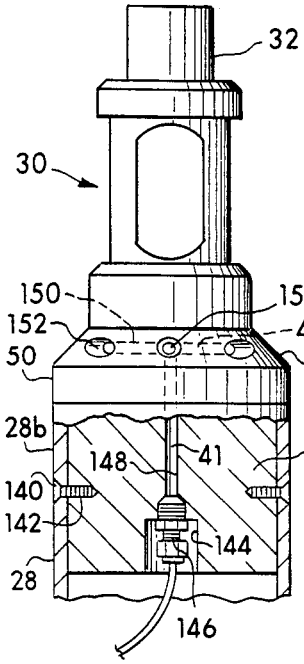
FIG. 3 is a fragmentary sectional view of a dispenser at a connector end of the invention shown in FIG. 1.

The weight of the piston 34 maintains a static pressure in the treatment fluid 18 contained in the bag 20. A fluid passageway, for ejecting the treatment fluid 18 at a pre-determined relatively slow flow rate, one half gallon to one gallon per day, is provided through the tool 10. The fluid passageway includes a first or compression means fluid passageway 38 extending longitudinally through the piston 34 (FIG. 4); a capillary tube 40 of predetermined length and inside diameter in fluid communication with the first fluid passageway 38 (FIGS. 3–5); and a second or dispenser fluid passageway 41 formed through a dispenser 42 selectively connected to the connector end 30 of the tool 10. (FIG. 3).

Figure 4:
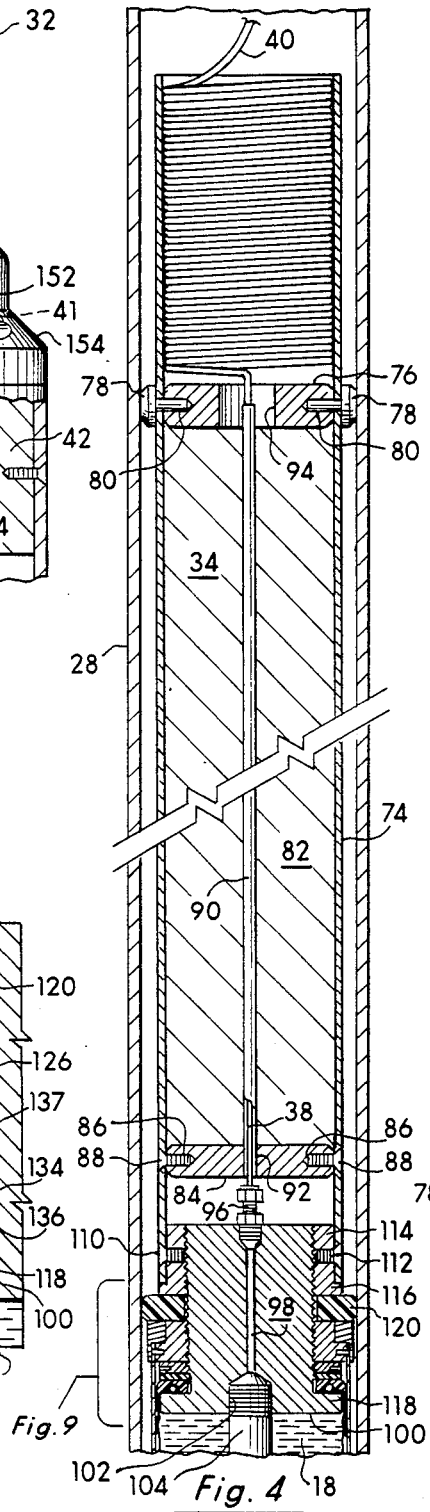
FIG. 4 is a fragmentary sectional view of a weighted piston of the invention shown in FIG. 1.
Figure 5:
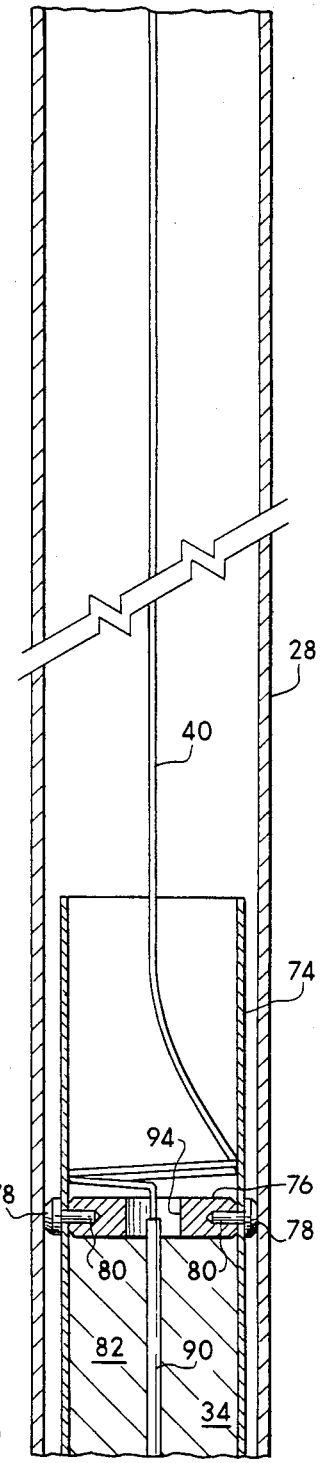
FIG. 5 is a fragmentary sectional view, similar to FIG. 4, showing an upper end of the weighted piston after treatment fluid stored in the invention has been ejected over a period of time.
Figure 6:
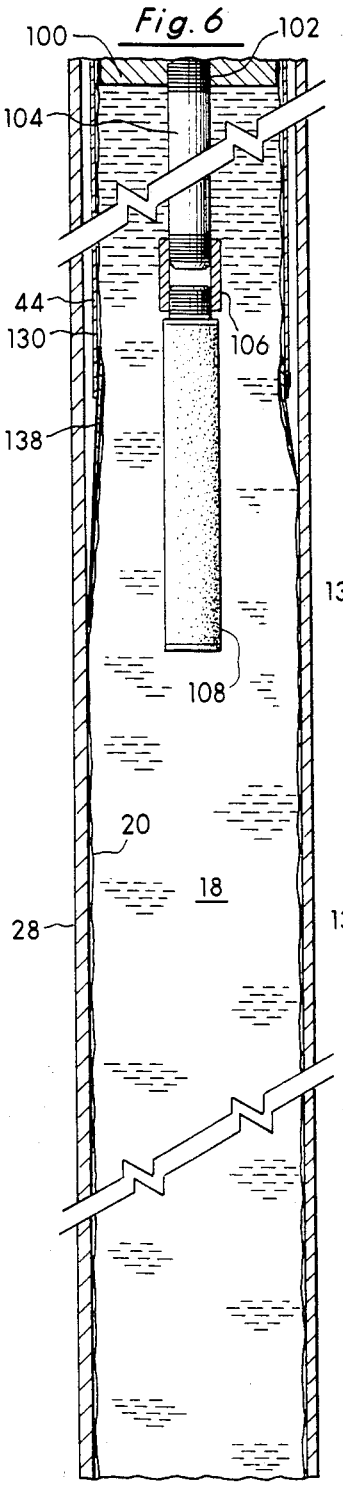
FIG. 6 is a fragmentary sectional view of a bag catcher and treatment fluid filter of the invention shown in FIG. 1.
Figure 7:
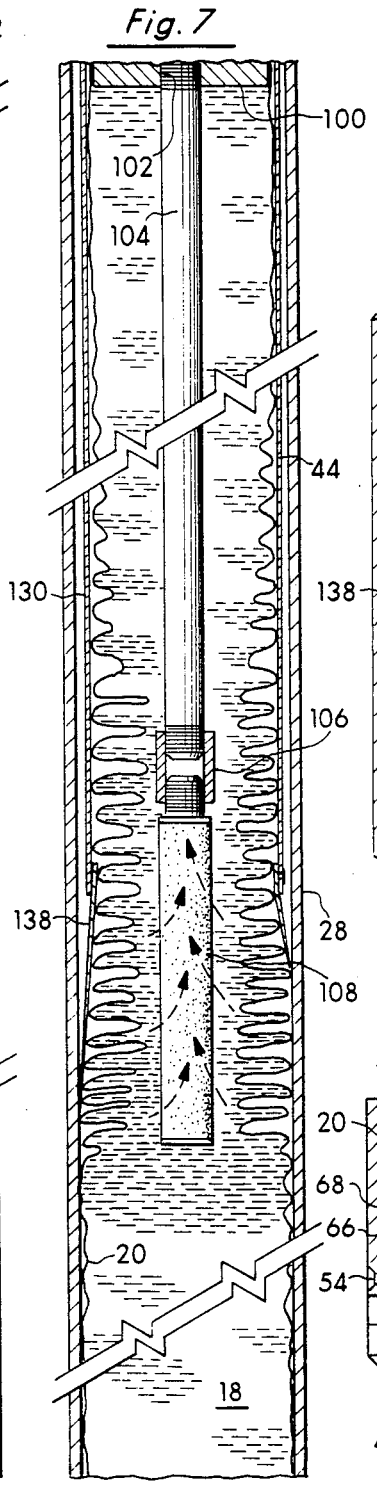
FIG. 7 is a fragmentary sectional view, similar to FIG. 6, after the treatment fluid stored in the invention has been ejected over a period of time.

The bag 20 is initially filled with treatment fluid 18, approximately 26 gallons, as seen in FIGS. 4 and 6. Over an extended period of time, at least several weeks, treatment fluid 18 is slowly ejected from the tool 10 into the chemicals and oil 24. As the bag 20 empties, the bag is collapsed into bag catcher 44. (FIG. 7). The capillary tube 40 is fed from a stowed position in the piston 34, as the piston 34 descends over time, to an extended position along the length of the tubular body 28. (FIG. 5).

The tubular body 28 is formed from five different four inch pipe sections **28*a*, each of ten feet in length. In a manner conventionally known in oil field technology, each pipe section has a male end and female end which are sequentially connected together. At the connector end 30, an eight inch long female nipple 28*b* is connected to a male end of the upper-most pipe section 28*a* to allow easier access to the dispenser 42, capillary tube 40 and piston 34 for assembly and refilling of the tool 10. In a like manner, the capped end 22 includes an eight inch long male nipple 28*c* having an externally threaded end which nipple 28*c* threadably connects to the lower-most pipe section 28*a*, and the internally threaded female end thereof. The nipple 28*c* allows easy access to the cap 36 and its connection to the lower-most end of the bag 20**.

The lower capped end 22 includes a frustoconically shaped polysulfone nose 46 which is in contact with the bridge support 16. (FIGS. 1 and 8). Because of the likely discrepancy between the types of material employed in the tubular body 28, nickel steel or titanium, and the well casing 12, the nose 46 is made of polysulfone, or similar material, in order to isolate the casing 12 from the tool 10 to help prevent galvanic interaction. Screw holes 48 are formed in the nose 46 so that the nose can be connected directly to the cap 36. Intermediate the nose 46 and cap 36 is ring 50 of fluorocarbon resin, like Teflon, or similar material, which is also used for galvanic isolation. A similar ring 50 is employed at the connector end 30 intermediate the fishing neck 32 and the dispenser 42. The cap 36 is of generally cylindrical configuration having radial threaded bores 52 machined therein to receive machine screws 54, which screws 54 pass through the nipple **28*c* to secure the cap 36 at the capped end 22. A threaded plug 56 is received in threaded axial bore 58. (FIG. 8). The bore 58 is relatively large compared to feed bore 60, which bore 60 is used to fill the bag 20 when the tool 10 has no treatment fluid 18**.

The tool 10 is filled in a generally horizontal position, the connector end 30 slightly lower than the capped end 22. The nose 46, ring 50, cap 36 and threaded plug 56, are disconnected and any unused treatment fluid 18 is drained through bores 58 and 60. A slight vacuum is applied to the bag 20 through the bores 58 and 60, collapsing the bag 20. The cap 36, the piston 34 and the bag 20, along with the tube 40, are pulled from the body 28. The dispenser 42 is disconnected from the connector end 30 and the tube 40 is disconnected from the dispenser 42 and the piston 34. A rope or wire (not shown) are connected to the piston 34, which wire is threaded through the tubular body 28, and the piston 34 is pulled to a point where the bag 20 is fully extended. The tube 40 is reconnected to the piston 34 and wound into the stowed position (FIG. 4), preferably held in position by wax, which wax melts when the tool 10 is placed into the downhole operating position. The tube 40 is reconnected to the dispenser 42. New and/or different treatment fluid 18 is introduced to the interior of the bag 20, which forms a reservoir for the treatment fluid 18, through the bore 58 and the feed bore 60.

Upper bearing surface 62 of the cap 36 has a continuous notch 64 formed around the periphery thereof. The notch 64 includes an angled surface and a flat surface perpendicular to the longitudinal axis of the cap 36. The flat surface has six longitudinal bores 66 formed therein at equal arcuate distances around the notch 64. A circular clamp 68 matingly fits into the notch 64 and has bores aligned with the bores 66. A lower end of the bag 20 is fit into the continuous notch 64 and liquid tight sealed between the notch 64 and the clamp 68 by tightening machine screws 70 through the clamp 68 and into the longitudinal bore 66. A resilient circular insert 72 covers screws 70 and prevents the lower end of the bag 20 from being damaged by the screws 70. The bag 20 extends substantially the length of the tubular body 28 to connect at an upper end to the piston 34, in a manner to be described shortly.

The piston 34 includes a three inch titanium pipe 74, five feet in length. An upper section of the pipe 74 remains hollow for storing a substantial amount of the capillary tube 40 when the tool 10 is full of treatment fluid 18. (FIG. 4). As treatment fluid 18 is ejected, the tube 40 is fed out of the pipe 74. (FIG. 5). A disc-shaped upper plug 76 supports the tube 40 and is held in position by six buttons 78 of fluorocarbon resin, like Teflon, or similar material, which thread through the pipe 74 and into the upper plug 76 into threaded bores 80. The buttons 78 extend from the outer surface of the pipe 74 a short distance to engage the interior of the tubular body 28 to establish sliding contact between the piston 34 and the interior of the tubular body 28. (FIGS. 2 and 4).

A lead weight 82, of approximately 200 lbs., fills the volume of space in the pipe 74 between the upper plug 76 and a lower plug 84. The lower plug 84 is substantially the same size and shape as the upper plug 76 and includes threaded bores 86 which receive screws 88 to connect the plug 84 to the pipe 74. A central tube 90 extends along the longitudinal axis of the tool 10 from the center of the lower plug 84 to the center of the upper plug 76 through openings 92 and 94 respectively. The central tube 90 carries the capillary tube 40, which defines a portion of the first or compression means fluid passageway 38. (FIG. 4). Below the lower plug 84 a titanium tube fitting 96 is secured to a bag seal base 100 at a central bore 98 thereof, which bag seal base 100 is partially inserted into the lower end of the pipe 74 of the piston 34.

The central bore 98 extends along the longitudinal axis of the bag seal base 100 terminating at a lower end of the base 100 in an extender pipe counterbore 102. (FIG. 6). An externally threaded end of one half inch extender pipe 104 is threadably received in the counterbore 102 and extends away from the bag seal base 100 twenty-five inches, terminating in another externally threaded end. The second externally threaded end of the extender pipe 104 is secured by a coupling 106 to a one half-inch 5 micron filter 108, which filter 108 extends into the reservoir of treatment fluid 18 within the bag 20. (FIG. 7). The filter 108 removes impurities that might clog the first and second fluid passageways 38 and 41, or the tube 40. The filter 108 is the start of the first passageway 38 in the embodiment shown.

The bag seal base 100 is threadably connected to an insert 114, which insert 114 is internally threaded to receive external threads of the bag seal base 100. The insert 114 is connected to the pipe 74 by screws 110, which screws 110 pass through the pipe 74 and into threaded bores 112 of the insert 114. The insert 114 includes a flange portion 116 which extends radially away from the bag seal base 100 and terminates at a position flush with the outer circumference of the pipe 74. A bottom end of the bag seal base 100 includes a like radially extending flange portion 118.

A ring shaped fluorocarbon resin bearing 120 threads onto the bag seal base 100 and abuts the flange portion 116. The bearing 120 extends outwardly to contact the inner surface of the tubular body 28 to provide, in cooperation with the buttons 78, means for reducing friction in sliding the piston 34 along the length of the tubular body 28. The ring bearing 120 superimposes an outer ring 122 having a depending portion 124. The depending portion 124 abuts against and circumscribes an L-shaped inner ring 126, which ring 126 is threaded onto the bag seal base 100 and has a plurality of biased pins 128 countersunk therein.

A tubular sleeve 130 of the bag catcher 44 is inserted between the depending portion 124 of the outer ring 122 and the inner ring 126. A circumferential groove 132 on the tubular sleeve 130 receives the biased pins 128 to releaseably secure the bag catcher 44 in position with respect to the piston 34.

Figure 9:
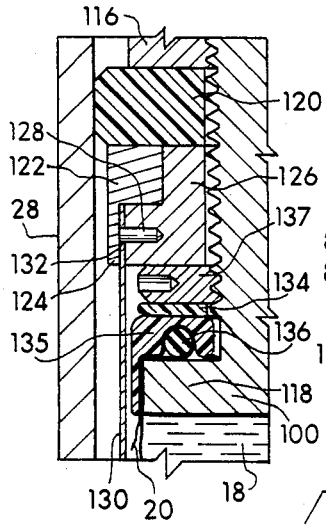
FIG. 9 is an enlarged fragmentary sectional view of the connection between the bag catcher and the weighted piston shown in FIG. 4.

A fluorocarbon resin, or similar material, washer 134, an L shaped cross section ring clamp 135 and a Viton "O" ring 136 are placed about the bag seal base 100 between a jam nut 137 threaded onto the bag seal base 100 and the flange portion 118. (FIG. 9). A top end of the bag 20 fits over the flange portion 118 of the bag seal base 100 and is wrapped over the "O" ring 136 under the clamp 135. The bag 20 is liquid-tight sealed at an edge thereof by the jam nut 137 forcing the bag 20 between the clamp 135 and the ring 136 and the flanged portion 118 and the clamp 135. The seal prevents treatment fluid 18 from leaving the upper end of the bag 20. It is therefore seen that the bag seal base 100 holds the entire assembly together positioning the tubular sleeve 130 and the bag 20 with respect thereto.

Figure 10:
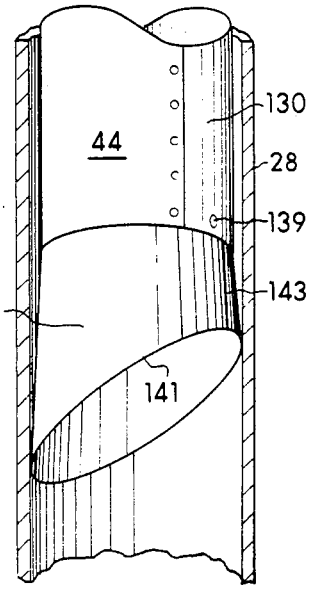
FIG. 10 is a perspective view of the bag catcher of the invention shown in FIG. 6.

The tubular sleeve 130 extends downwardly from the bag seal base 100 approximately twenty inches and terminates at a circular open end which has a flexible funnel or scoop 138 fitted therein. (FIGS. 6, 7 and 10). The flexible scoop 138 is connected by a rivet 139 to the tubular sleeve 130 and has a bottom edge 141 which angles generally downwardly relative to a plane perpendicular to the longitudinal axis of the tool 10. The rivet 139 holds free edges 143 of the scoop 138 together at a pivot point. The free edges 143 move under the spring force inherent in the scoop 138 to force the bottom edge 141 into spring biased contact with the inner surface of the body 28. The flexible scoop 138 extends outwardly from the sleeve 130 to engage the inner surface of the tubular body 28. As the piston 34 moves from the connector end 30 to the capped end 22, the scoop 138 gathers up the emptying bag 20. The sleeve 130 and scoop 138 are both coated with a fluorocarbon resin or similar material.

The bag 20 is stored in the tubular sleeve 130 after the scoop 138 gathers it up. It is noted that as the tool 10 ejects the treatment fluid 18, the filter 108 will bottom out on the upper bearing surface 62 of the cap 36 before the bag catcher 44 reaches that point. A small amount of unused treatment fluid 18, approximately twenty-five inches of the length and inside diameter of the bag 20, which is approximately forty-five to fifty feet in total length, will retain treatment fluid 18.

The dispenser 42 is secured to the female nipple **28*b* at the connector end 30 by machine screws 140 which are received through the nipple 28*b* by radially extending threaded bores 142. (FIG. 3). A counterbore 144** extends a relatively short distance into the solid dispenser 42 along a central axis thereof to receive an upper end of the tube 40 in a threaded tube fitting 146. A central bore 148, which forms a portion of the second or dispenser fluid passageway 41, carries the treatment fluid 18 centrally along the dispenser 42 to bores 150, which bores 150 exit the dispenser 42 and the tool 10 through ejection ports 152 formed in a truncated conical surface 154 of the dispenser 42.

In the preferred embodiment, the flow rate of the treatment fluid 18 is governed by the size and length and inside diameter of the passageway through which the fluid must flow. The flow rate of the treatment fluid 18 is determined in a conventional manner as a result of the length and inside diameter of the fluid passageway, which comprises the compression means fluid passageway 38, the capillary tube 40 and the dispenser fluid passageway 44. The viscosity of the treatment fluid 18 and the pressure applied by the piston 34 all contribute to determining the flow rate of the treatment fluid 18, which flow rate can be calculated and set using conventional engineering principles.

Although the invention has been described with a certain degree of particularity, the scope of the invention is more particularly seen in the appended claims.

What is claimed is:

1. A treatment fluid device insertable into an oil well comprising in combination:

a tubular body having a hollow interior selectively closed at a lower end and having a connector selectively secured at an upper end;

an elongated bladder, extending along the interior of said body, for storing treatment fluid in an interior of said bladder, said bladder having an upper end and a lower end sealingly connected to the lower end of said body.

compression means, slideable along the interior of said tubular body and sealingly connected to the upper end of said bladder, for maintaining constant pressure on the treatment fluid, said compression means having a bore therethrough in fluid communication with the interior of the bladder; and a passageway for receiving said fluid from said bore and communicating said fluid to the exterior of said device.

2. The invention as defined in claim 1 wherein said bore and said passageway have a predetermined total length and diameter, which establishes a flow rate for said treatment fluid.

3. The invention as defined in claim 1 wherein said compression means has releaseably connected thereto catcher means for gathering and storing said bladder as said compression means slides along the interior of said tubular body and said bladder ejects said treatment fluid, said catcher means including at a lower end a scoop having sliding contact with the interior of said tubular body and a tubular sleeve connected to said scoop at an upper end for storing said bladder, said scoop and sleeve circumscribing said bladder.

4. The invention as defined in claim 1 wherein said lower end of said tubular body includes a cap connected thereto having a feed bore formed therethrough for selective admission of treatment fluid.

5. The invention as defined in claim 2 wherein said flow rate is one-half to one gallon per day.

6. The invention as defined in claim 1 wherein said compression means includes means for storing an elongated flexible tube, which tube forms part of said passageway, said tube in fluid communication with said bore and feeding out of said compression means as said compression means slides along the interior of said tubular body, dispenser means connected to an upper end of said tube, said dispenser means having a fluid passageway formed therethrough defining another part of said passageway, said dispenser passageway ejecting said treatment fluid from said dispenser near said connector.

7. A treatment fluid device insertable into an oil well, comprising in combination:

a tubular body having a connector end attachable to means for raising and lowering said device, a hollow interior and a cap sealing off said interior at a closed end of said device; and a deformable bladder for holding wellbore treatment fluid having a lower end connected to and in selective fluid communication with said cap and an upper end secured about a weight applying constant pressure to said treatment fluid, said weight having a first fluid passageway therethrough in fluid communication with said bladder which said fluid passageway conveys fluid to a flexible capillary tube of preestablished length and cross-sectional size interconnecting said first fluid passageway and a second fluid passageway formed in said connector, said second fluid passageway passing through said connector and providing communication between said capillary tube and said wellbore, whereby treatment fluid is ejected into said wellbore at a predetermined rate.

8. A method for ejecting wellbore treatment fluid into a producing oil well, comprising the following steps:

storing a predetermined amount of treatment fluid in a flexible bladder;

applying a constant compression force to said bladder by means of a gravitational force from a weighted piston positioned above said bladder;

communicating said treatment fluid from said bladder by the compression force through a passageway of predetermined length and cross-section to establish a predetermined flow rate; and ejecting said wellbore treatment fluid from said bladder at said flow rate at a predetermined position in said oil well.

9. The invention as defined i claim 8 wherein said predetermined position is approximately at the depth of production perforations in an oil well casing of the oil well.

10. A method for ejecting wellbore treatment fluid into a producing oil well, comprising the following steps;

storing a predetermined amount of treatment fluid in a flexible bladder;

applying a constant compression force to said bladder by means of a gravitational force from a weighted piston positioned above said bladder;

communicating said treatment fluid from said bladder through an orifice of predetermined size to establish a predetermined flow rate;

ejecting said wellbore treatment fluid from said bladder at said flow rate at a predetermined position in said oil well.

11. An inhibitor release tool for use with an oil well, comprising in combination:

an elongated tubular body having a lower capped end and an upper connector end, said upper connector end for selectively connecting to means for raising and lowering said tool and said capped end including a cap for selectively admitting wellbore treatment fluid;

an elongated flexible membrane bladder extending substantially the length of said tubular body and being sealingly connected to said cap at a lower end and at an upper end to a weighted piston, said bladder containing said wellbore treatment fluid; and a fluid passageway for communicating said treatment fluid from said bladder to the exterior of said tool, including a piston fluid passageway extending longitudinally through said piston, an elongated flexible capillary tube connected at one end to said piston fluid passageway and at another end to a dispenser fluid passageway formed through a dispenser fixedly connected to said tubular body at said connector end, whereby the length and diameter of said passageway, and the pressure applied to the treatment fluid by the piston, establishes a predetermined flow rate of said treatment fluid from said tool.

12. The invention as defined in claim 11 wherein said piston includes, at a lower end thereof, means for selectively connecting said piston to a bag catcher, said bag catcher including an elongated tubular sleeve circumscribing said bag and connected at a lower end thereof to a scoop conformably contacting the interior of said tubular body, whereby said scoop gathers said bag from said tubular body and said sleeve stores said bag as said tool ejects treatment fluid.

13. The invention as defined in claim 11 wherein said bag holds 26 gallons of treatment fluid and is approximately three inches in diameter, said piston weighs approximately 200 pounds, and said predetermined flow rate is one-half to one gallon per day.

14. The invention as defined in claim 11 wherein said piston includes, at either end thereof, means projecting from said piston for making sliding contact with the interior of said tubular body.

15. The invention as defined in claim 12 wherein said interior of said tubular body and said scoop are coated with fluorocarbon resin.

16. An oil well tool for in situ release of wellbore treatment fluid in an oil well comprising in combination:

an elongated tubular body having an upper connector end, closed with a dispenser, for connecting to means for raising and lowering said tool and a lower end, closed with a cap;

a bladder for holding said treatment fluid, said bladder extending substantially the length of said tubular body sealingly connected at an upper end to a weighted piston slideable along said tubular body and at a lower end to said cap;

a passageway through said piston and said dispenser interconnected by flexible conduit means for communicating said treatment fluid from said bladder to the oil well at a predetermined flow rate; and catcher means mounted to said piston and circumscribing said bladder for gathering and storing said bladder as treatment fluid is ejected.

* * * * *